US005775388A

United States Patent [19]

Toft et al.

[11] Patent Number: 5,775,388

[45] Date of Patent: Jul. 7, 1998

[54] VALVE BAG SPOUT APPARATUS

[75] Inventors: Richard J. Toft, Brooklyn Park; Wayne H. Gulbranson, Blaine, both of Minn.

[73] Assignee: Bemis Company, Inc., Minneapolis, Minn.

[21] Appl. No.: 828,841

[22] Filed: Mar. 24, 1997

[51] Int. Cl.[6] ..... B65B 1/04

[52] U.S. Cl. ..... 141/313; 141/315; 141/10

[58] Field of Search ..... 141/313–317, 141/114, 10

[56] References Cited

U.S. PATENT DOCUMENTS 2,296,163 9/1942 Hartman ..... 141/10

3,886,983 6/1975 Forssen et al. ..... 141/315

*Primary Examiner*—J. Casimer Jacyna

*Assistant Examiner*—Steven O. Douglas

*Attorney, Agent, or Firm*—Clayton R. Johnson

[57] ABSTRACT

A valve bag spout is mountable to a bag filling machine for being extended into the valve sleeve to discharge product into the valve bag. The maximum peripheral dimension of the spout filling tube is much smaller than the inner peripheral dimension of the valve sleeve while a wing assembly is mounted to the filling tube to have its wings extend outwardly of diametrically opposite sides of the filling tube in symmetrical relationship to the filling tube central axis. The wings diverge horizontally transversely outwardly in a rearward direction from the spout front discharge end portion. The front end of the wing assembly is circular while in a rearward direction gradually transitions to a flattened elliptical shape. The maximum height of the wing assembly is only slightly greater than the outer diameter of the filling tube and is much smaller than its maximum transverse horizontal dimension. Due to the provision of the wing assembly, the maximum vertical dimension of the valve sleeve opening is substantially less than if a frustoconical or circular spout portion were used to form a sealing fit with the valve sleeve interior. As a result, with the wing assembly, the likelihood of obtaining a poor valve seal with the spout is substantially decreased.

18 Claims, 6 Drawing Sheets

VALVE BAG SPOUT APPARATUS

BACKGROUND OF THE INVENTION

The present invention relates to a spout for a bag filling machine that is usable for filling a valve bag.

In the prior art, it is old to use valve bag filling spouts that are tubular (circular) in cross section throughout a major of their axial length with the portion extended into the bag being of an outer. circumference that is nearly the same as that of the inner circumference of the bag valve sleeve in its expanded circular configuration. In other valve bag filling spouts, the spout has a tubular portion with a tapered portion along at least the part of the spout that is extended into the valve bag sleeve that is frustoconical with its minor base closer to the spout discharge end than its major base. With both of the above types of spouts, as the sleeve moves of the spout, the valve sleeve opening is circular or slightly elliptical. With the axial spaced transverse cross sectional views of the tapered portion of a spout being circular, the outer peripheral surface of the spout is of progressively increasing diameters in a direction axially away from the spout discharge outlet. In either situation, just as the filled bag is removed from the bag valve sleeve, the height of the sleeve opening is nearly the same as the diameter of the periphery of the spout adjacent to the spout part against which the valve sleeve abuts to form a snug fit with the radial adjacent part of the valve sleeve, the valve sleeve opening being very large for wider width bags and allowing significant amounts of product to settle in the valve sleeve interior as the bag moves off the spout. That is, usually the greater the width of the bag top, the greater the outer diameter of the bag valve sleeve in its fully open position and the diameter of the filling tube portion that is extended into the sleeve for filling the bag. As a result, before the bag valve sleeve fully closes with the withdrawal of the bag from the filling spout, product material frequently lodges in the interior of the sleeve.

With product material remaining in the sleeve, as the valve sleeve closes, frequently, a good valve sleeve seal is not obtainable and a space or channel remains in the sleeve interior for product to sift through or a leakage channel opens when the bag is moved. Such can occur regardless of whether the valve bag is of a type that relies on product in the filled bag abutting against the bag top to retain the bag top valve sleeve in a sealed condition or of a type of an extended sleeve that is sealed by, for example heat sealing, or sewing, or similar types ways for retaining the valve sleeve in a closed condition.

With a typical valve bagger machine, a bag, in being filled is supported- at its bottom by a pivotally mounted saddle while the filling spout is fixed. Usually, in removing the filled bag from the spout, the saddle pivots from back to front which pushes the bag bottom up at the time the spout is still in the valve sleeve. This shortens the bag a little, as pushing the bottom of the bag into itself moves product up to the top of the bag. This can result in "roster tailing" or product oozing out of the valve sleeve because of product being pushed to the top. Also, with fine particle, as the bag is moved off the spout, there can be puffing of product into the sleeve interior which can present a greater problem with the type of valve bags that utilize heat sealing of the valve sleeve.

Problems such as the above can be especially great, if as the saddle pivots, the valve sleeve is, nearly or completely wide open. In order to minimize or eliminate problems such as the above, this invention has been made.

SUMMARY OF THE INVENTION

A spout utilized with a valve bag filling machine has an axially elongated filling tube with a front discharge end portion and a mounting flange on the axially opposite end portion. Joined to extend transversely outwardly on diametrically opposite sides of the filling tube with axially elongated wings with transversely opposite rounded side portions, that as viewed from the top, diverge in an axial direction rearwardly of the spout discharge end portion. Each wing has top and bottom surface portions that diverge in a transverse direction away from its side edge toward the filling tube and advantageously extends generally tangentially to the top and bottom parts of the filling tube and then are arcuately curved to conform to the radial adjacent part of the filling tube. In the horizontal plane of the spout central axis, the included angle of the rounded side portions diverge in a rearward direction that preferably is less that 45 degrees. Also, it is preferably that the combination of the wings and filling tube at one transverse cross sectional part are of maximum exterior transverse dimensions sufficiently great to provide a snug fit with the valve sleeve interior surface (seal with the valve sleeve).

One of the objects of this invention is to provide new and novel means for filling valve bags and reduce the leakage or sifting from the filled bags. Another object of this invention is to provide new and novel means for reducing the vertical height of the opening of the sleeve of a valve bag as the bag is being filled while fully opening the valve sleeve.

As referred herein, transverse refers to a dimension, or a direction, or a plane or cross section in a plane(s) perpendicular to the central axis of the spout filling tube.

DETAILED DESCRIPTION OF THE INVENTION

Figure 1:
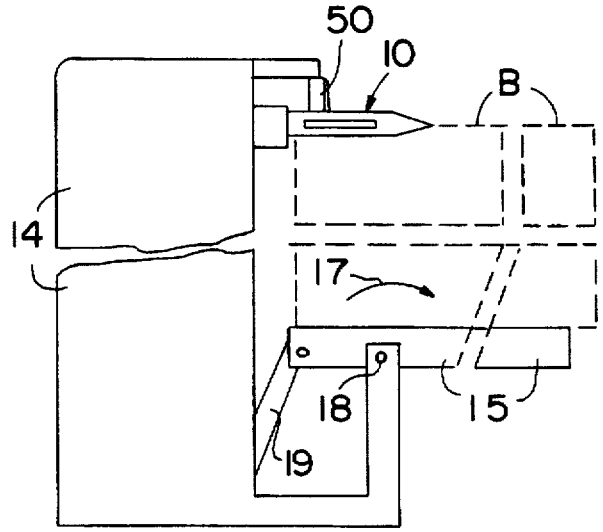
FIG. 1 is a simplified, diagrammatic showing of a valve bag filling machine with a filling spout and a valve bag being shown in phantom with horizontal and vertical intermediate parts broken away.
Figure 2:
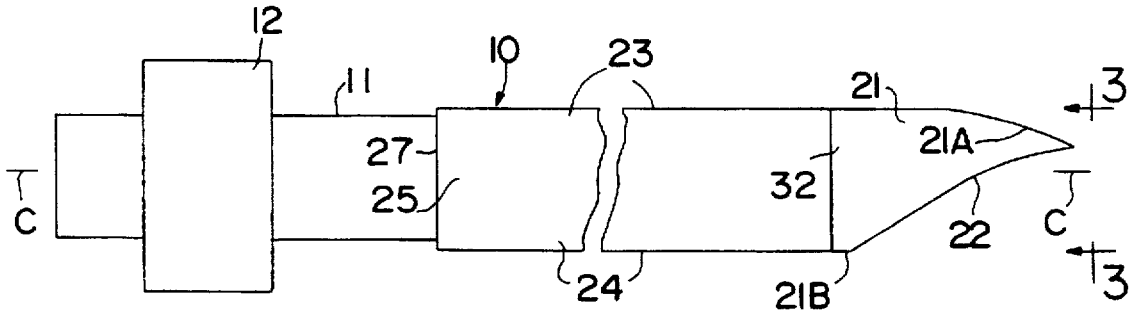
FIG. 2 is a side view of the first embodiment of the valve bag spout of this invention with an-axial intermediate part broken away, said view being generally taken along the line and in the direction of the arrows 2—2 of FIG. 4.
Figure 3:
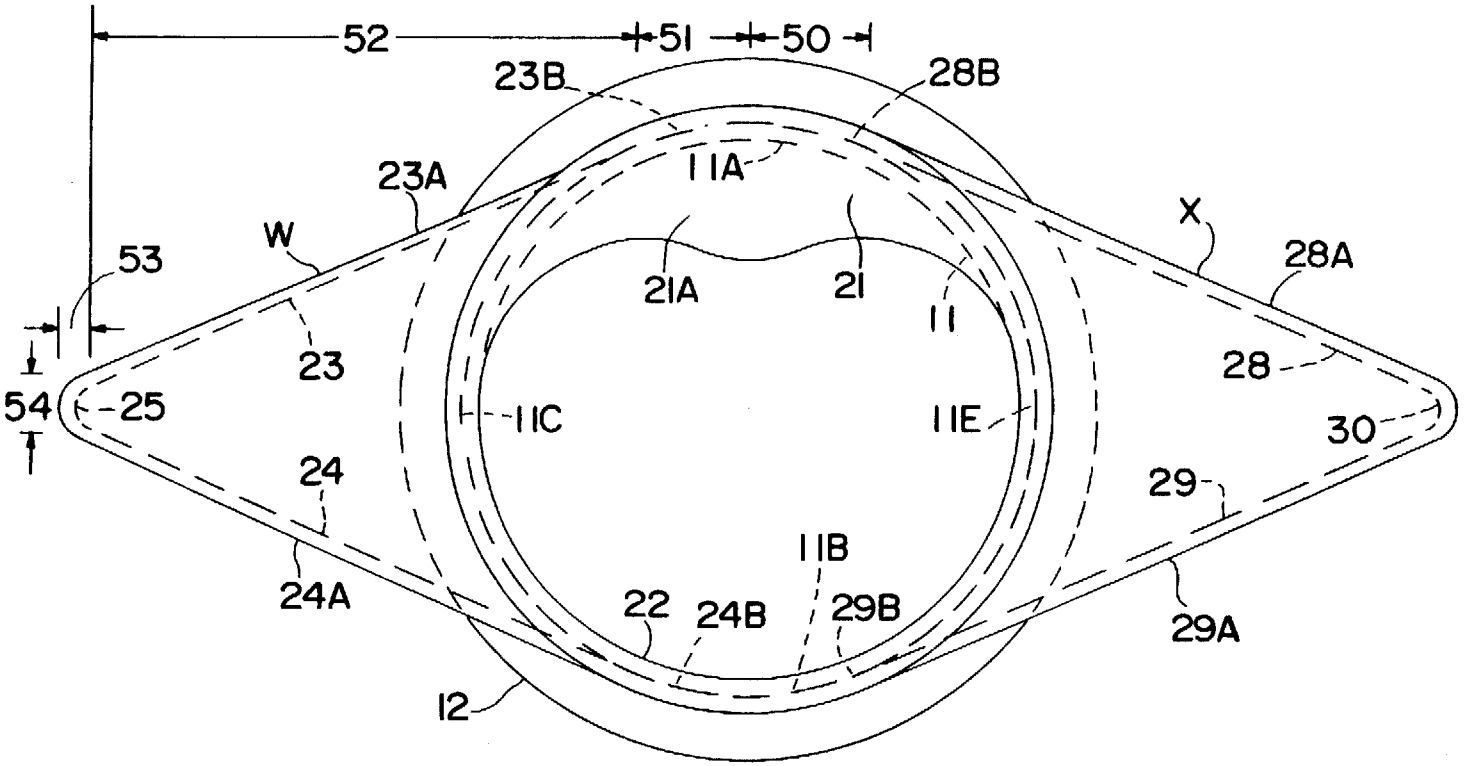
FIG. 3 is an enlarged front view of the valve bag spout that is generally taken along the line and in the direction of the arrows 3—3 of FIG. 2.

Referring to FIGS. 1–5, the first embodiment of the bag valve spout of this invention, generally designated 10, includes an axially (longitudinally) elongated, circular cylindrical filling tube 11 having an annular mounting flange 12 on the rear end portion of the filling tube to facilitate mountingly retaining the spout to a conventional valve bag filling machine 14 that is diagrammatically shown in FIG. 1. The bag filling machine includes a saddle 15 for supporting a valve bag B as the bag is being filled. The saddle is mounted to pivot in the direction of arrow 17 about pivot 18 as the filled bag moves off the spout and the saddle onto, for example, a conveyor (not shown). The bag filling machine also includes conventional power operated means 19, for example a piston cylinder combination, for pivoting the saddle from a bag supporting position to its pivoted bag discharge position or mechanical mechanism for pushing a filled bag off a stationary support (not shown).

The front discharge end of the spout comprises a discharge end portion 21 having its rear end 23B being circular cylindrical and its upper front end part 21A arcuately curved forwardly and downwardly about a horizontal transverse axis to provide a downwardly and rearwardly inclined discharge opening 22. Extending along the major part of the length of the filling tube axial between the mounting flange and discharge end portion 21 to extend transversely outwardly of diametric opposite sides of the filling tube is a wing assembly having wings W, X which advantageously may be formed as a single unitary unit with the filling tube extended therethrough. The wings W and X are identical, symmetrical and other than being oppositely faced, extend transversely outwardly of diametric opposite filling tube side portions 11C and 11D respectively. For purposes of facilitating the description of the invention, the wings will be described as two members which have upper and bottom axial edges (represented by dotted line E in FIG. 4) integrally joined to one another at the top and bottom of the filling tube.

The wing W includes an axially elongated top panel 23 having an axial edge E and, along at least its rear portion, is transversely arcuately curved downwardly at arcuate portion 23B to conform to the outer circumference of the filling tube and then is sloped downwardly along portion 23A from the tube top tube portion 11A in a direction transversely away from the filling tube. Panel 23 has an opposite axial edge joined to the upper, predominately axially extending edge of rounded side portion 25 that is arcuately curved to open toward the filling tube 11. At the rear peripheral edge 27 of the wing assembly, the transverse spacing of axial edge E from the juncture of the arcuate portion 23B to the transverse outwardly and downwardly sloped portion 23A of the panel 23 is represented by transverse dimension 51 in FIG. 3 while the transverse spacing from the last mentioned juncture to the rounded side portion 25 is represented by dimension 52. Similarly, the transverse dimension of the rounded side portion is represented by dimension 53 while the height of the rounded side portion is represented by dimension 54.

The lower axial edge of the rounded side portion 25 is joined to the transversely outer, predominately axially extending edge of portion 24A of the lower panel 24 of the wing W and is transversely sloped downwardly along at least its rear portion and then has an arcuately curved portion 24B (represented by the transverse dimension 51 at the rear peripheral edge 27) to conform to the lower arcuate bottom part 11B of the filling tube to lower axial edge E. In an axial forward direction, the rounded side portion 25 as viewed in plan progressively converges toward the central axis C-C of the filling tube, advantageously at an acute angle A substantially less than 30 degrees.

Similarly, the wing X includes an axially elongated top panel 28 having axial edge E and along at least its rear portion is transversely arcuately curved downwardly at 28B as represented by transverse dimension 50 at rear edge 27 to conform to the outer circumference of the filling tube along arcuate portion 288 and then is sloped downwardly along portion 28A in a direction transversely away from the filling tube, and an opposite, predominately axially extending edge joined to the upper axial edge of rounded side portion 30 that is arcuately curved to open toward the filling tube 15. The lower predominantly axially extending edge of the rounded side portion 30 is joined to the transversely outer, predominately axially extending edge of the panel portion 29A of lower panel 29 of the wing W which is transversely sloped upwardly along at least its rear portion and then the panel has an arcuate portion 29B arcuately curved to conform to the lower arcuate portion 11B of the bottom of the filling tube to lower axial edge E. In an axial forward direction the rounded side portion 30 as viewed in plan progressively converges toward the central axis C—C, advantageously at an acute angle less than 30 degrees.

For wing W, in an axial forward direction from the rear peripheral edge 27, in transverse cross sectional planes, the included angle between panel portions 23A and 24A progressively increases in a forward direction while the circumferences of the arcuate portions 23B and 24B progressively increase and the transverse dimension of panel portions 23A and 24A progressively decrease until the circumference of the rounded side portion 25 is the same as the wing semi-circular portion at the front peripheral edge 32 of the wing assembly. Advantageously, in transverse planes perpendicular to the central axis C—C, panel portions 23A and 24A intersect with the respective arcuate portion 23B and 24B in general tangential relationship. Further, in transverse planes, each of the panels portions 23A, 24A, 28A and 29A in cross section is linear and in each such plane, are of equal dimensions. Similarly, the panels and rounded side portion of wing X are shaped as described in the preceding sentence. Thus, progressing from the rear peripheral terminal edge 27 of the wings W and X, the combination of panels 23 and 24 and rounded side portions 25 gradually transitions from a somewhat flat semi-elliptical shape, particularly transversely outwardly of the filling tube, to a semi-circular shape that conforms to the outer circumference of the filling tube as do the combination of panels 28, 29 and rounded side portion 30.

Thus, the maximum transverse spacing T of the rounded side portions 25 and 30 is at the peripheral edge 27 and advantageously the dimension T is at least one and one half times the outer diameter of the filling tube and also of the maximum vertical dimension of the wing assembly.

The vertical height of the rounded side portions at their juncture to the respective pair of portions 23A, 24A and 28A, 29A at the wing assembly rear peripheral edge is advantageously less than 20 percent of the vertical diameter dimension of the diametric opposite arcuate portions 23B, 24B and 28B, 29B. Further, the rounded side portions 25 and 30 converge toward one another at equal angles relative to the central axis while the radii of curvature of the rounded side portions from the rear peripheral edge 27 progressively increase until intersecting with the front terminal peripheral edge 32 of the combination of the wings which is substantially circular in surrounding relationship to the filling tube. Accordingly, the maximum vertical spacing of adjacent axial edges of the arcuate portions of panels 23 and 24 on one diametric side of the filling tube and also of the panels 28 and 29 at the rear peripheral edge 27 of the wings and in planes perpendicular to the central axis C—C, becomes progressively smaller in a forward direction while the arcuate radii of rounded side portions 25 and 30 in said planes and in said direction become progressively larger. Also, the maximum radial spacing of each of the rounded side portions 25 and 30 from the central axis in the planes referred to in the preceding sentence becomes progressively smaller in a forward direction. Further, the rounded side portions 25 and 30 are vertically centered relative to the central axis. As a result, the arcuate dimensions of the arcuate portions of each of the panels 23, 24, 28 and 29 in planes perpendicular to the central axis become larger in a forward direction and the tapered dimensions of portions 23A, 24A, 28A and 29A become progressively smaller in a forward direction.

With the spout of this invention, preferably the filling tube from its front end to at least the mounting flange is of constant inner and outer diameters while the transverse peripheral dimensions of the wing assembly from the peripheral, front wing assembly edge 32 progressively increase in a rearward direction. Since, advantageously, the wings are made of sheet metal, even if the outer diameter of the cylindrical portion 21B of the discharge end portion 21 is not the same as that of the filling tube, the differences in outer diameters are very small and the welding or soldering of the circular parts (arcuate portions) of the wings to the filling tube provides a smooth transition from the discharge end portion 21 to the circular front edge 32 of the joined wings. The maximum vertical dimension H of wings throughout its axial length remains substantially constant while the transverse dimensions in the horizontal plane of the central axis C-C progressively increase from the front peripheral edge 32 to the rear peripheral edge 27.

Figure 4:
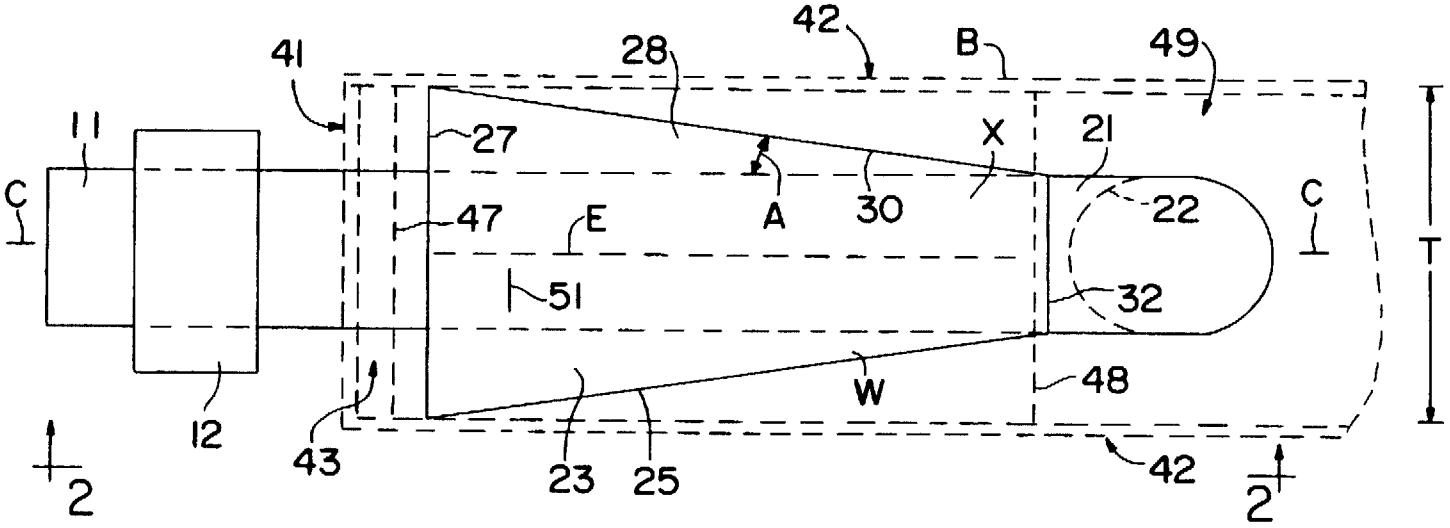
FIG. 4 is a top view of the valve bag spout of FIG. 2 together with a fragmentary top portion of a valve bag shown in phantom and the spout extended into the bag valve to discharge product into the bag.
Figure 5:
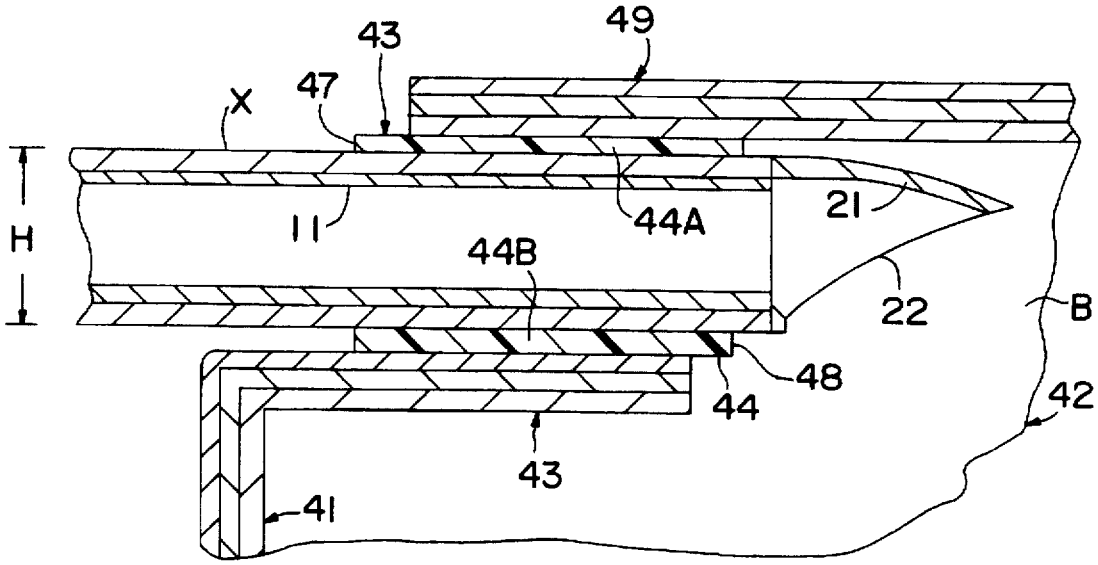
FIG. 5 is a fragmentary vertical, axial cross sectional view of the valve bag spout of this invention inserted into a stepped end bag valve sleeve in a position for filling a valve bag with the thickness of, the bag walls and bag filling tube being more greatly exaggerated than the exaggeration of the height of the wing and filling tube.
Figure 6:
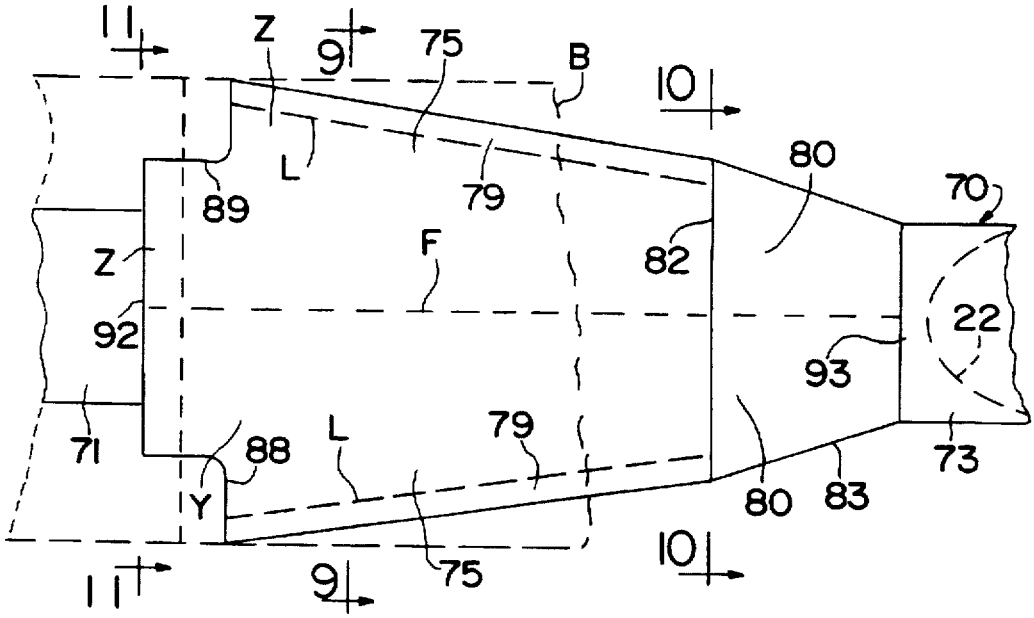
FIG. 6 is a fragmentary plan view of the second embodiment of the spout of this invention with a fragmentary view of a bag top being shown in phantom and the spout extended thereinto, said view being generally taken along the line and in the direction of the arrows 6–6 of FIG. 7.
Figure 7:
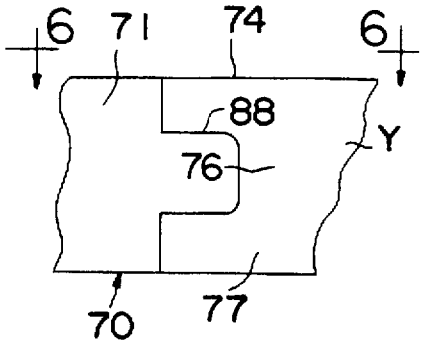
FIG. 7 is a fragmentary side view of the rear corner portion of a wing and the adjacent part of the filling tube of the second embodiment.
Figure 8:
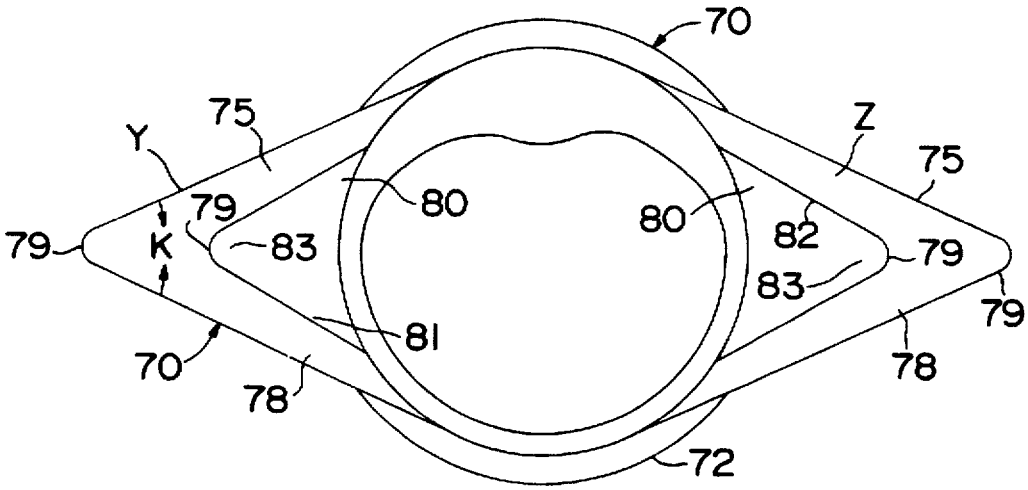
FIG. 8 is a front view of the second embodiment.
Figure 9:
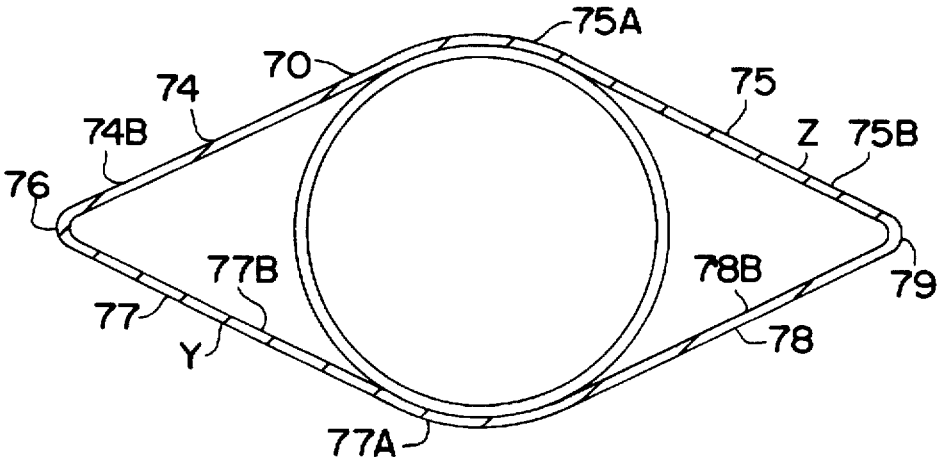
FIGS. 9, 10 and 11 are a rear view and transverse cross sectional views generally taken along the line and in the direction of the arrows 9—9, 10—10 and 11—11 respectively of FIG. 6 that are shown on the same scale as one another to more clearly show the shape of the wing assembly.
Figure 10:
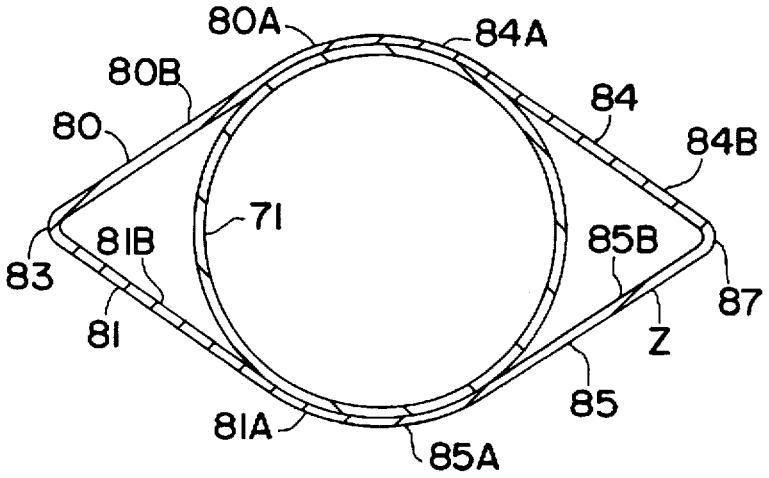
Figure 11:
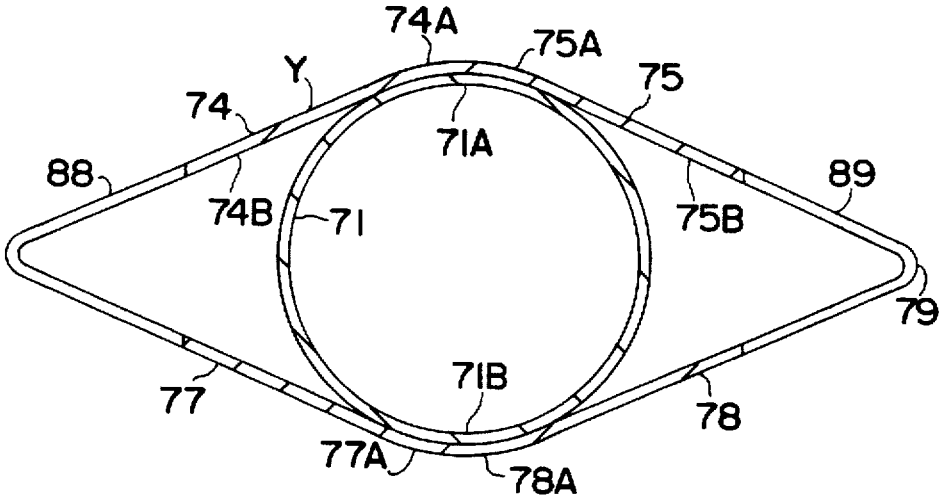

Before further describing the invention, one example of a conventional valve bag B will be briefly referred to with reference to FIGS. 4 and 5. That is, the bag may be a multiple layered bag having an end wall 41, side walls 42, a bag top having an infold flap 43 and an outfold flap 49 in part overlapping the infold flap and a valve sleeve 44 extending between the flaps. The valve sleeve has an Interior end 48 opening to the interior of the bag and an exterior end opening 47.

In using the valve bag spout 10, at least one of the bag and the spout are moved relative to the other to have the spout discharge end portion extend through the valve sleeve 44 to have the spout discharge end portion with its opening 22 horizontally more remote from the illustrated end wall 41 than the valve tube interior end 48 to discharge product into the bag interior. The bag may be manually positioned on the spout, or conventional valve bag filling machines may move the bag onto the spout. To extend the spout discharge end portion into the valve sleeve, the exterior end portion of the sleeve is opened to be of a vertical height substantially the same as, or slightly greater than, the outer diameter of the cylindrical portion 22B of the spout discharge end portion 22 with the junctures of the valve sleeve top and bottom walls (44A and 44B respectively) in substantially transverse spaced relationship to the spout. As the spout extends into the valve sleeve, the wings move progressively further into the sleeve and accordingly, at the sleeve exterior opening 47, the total transverse spacing of the juncture of the valve sleeve top and bottom walls from the wing rounded side portions 25 and 30 progressively decreases.

At the time the rounded side portions are in abutting relationship to, or very closely adjacent to, the juncture of top and bottom sleeve walls closely adjacent to the valve sleeve exterior opening 27, the spout wings form a snug fit (preferably a seal) with the adjacent parts of the valve sleeve, and the spout opening 22 is inwardly of the sleeve interior opening 48. Accordingly, at this time, the valve sleeve terminal edge (opening) 47 is usually axially intermediate the peripheral edges 27 and 32. However, during the relative movement of the wings into the valve sleeve, the wings do not force the valve sleeve to open any further in a maximum vertical direction than it was initially opened as the circular forward end 32 of the wings entering into the valve sleeve. When the spout is in the bag filling position of FIGS. 1 and 5, a conventional bag clamp, depicted by a block 50 of the filling machine 14, clamps the bag top to the spout to hold the bag top to the filling spout as the valve bag is being filled.

With the wings, when the spout is in its position to discharge product into the bag, the width (transverse dimension T) of the opening of the valve sleeve adjacent to the sleeve exterior edge 47 is substantially greater than the maximum height H of the valve sleeve opening. As the valve sleeve and filling spout are relatively moved to withdraw the bag filling spout from the valve sleeve, for example by the saddle 15 pivoting in the direction of arrow 17 if a machine such as 14 is used, there is no structure closely adjacent to the intersection of the sleeve top and bottom walls near to the exterior sleeve peripheral edge 47 such as there was before the start of the withdrawal, the valve sleeve in these areas (top wall outfold flap side edge portions) start to close (collapse) toward its closed position. Due to the provision of the wings, as the valve sleeve is moved off the spout, the vertical dimensions through which the top wall has to collapse relative to the sleeve bottom wall are substantially smaller than would occur if there were used conventional filling tubes that are frustoconical and/or are substantially circular cylindrical throughout the portions that abut against the conventional filling in snug fitting relationship to retain the sleeve in its fully open position when product is being discharged into the bag. Since the maximum vertical dimensions of the relative collapsing movement of the valve sleeve top and bottom walls is substantially decreased with this invention from that of known conventional bag spouts is in snug fitting (sealing) relationship with the spout, there is less time for product to move between the valve sleeve top and bottom walls and less chance of product puffing or being drawn into the valve sleeve.

When using a saddle that is pivoted to move the bag off a bag filling machine of the general type referred to in FIG. 1, as the saddle starts to pivot with the bag still on the spout, the saddle comes into the bottom of the bag before the bag starts moving off the spout. This pushes the bottom of the bag into itself which moves product in the bag upwardly toward the top of the bag. This can result in product oozing out of the valve sleeve, particularly with the valve sleeve in fully open position with a conventional valve bag filling spout. However, with the flattened spout of this invention, the tendency for oozing is greatly reduced since the vertical height of the opening of the valve sleeve is relatively small and the pushing up of product will close the valve sleeve rather than coming into and/or out of the valve sleeve. The greater the bag top width and the larger the diameter of the filling tube used, the greater the chance for oozing.

As one example of the first embodiment but not otherwise as a limitation thereon, the outer circumference of the filling tube may be about 5.9 inches with a vertical outer diameter of about 1.89 while at line 51 in FIG. 4, the transverse peripheral dimension is about 9.5 inches. To obtain a circular peripheral dimension with a convention valve bag filling spout, the diameter of the filling spout portion forming a close fit with the valve sleeve would be slightly over 3 inches. Thus, the maximum height of the interior valve sleeve opening is substantially less with this invention in contrast to using a spout having a circular or frustoconical portion to form a snug fit with the valve sleeve.

Referring to FIGS. 6–11, the second embodiment of the invention, generally designated 70, has a filling tube 71, a mounting flange 72 and a front discharge end portion 73 that may be the same-as the corresponding members of the first embodiment. Axially intermediate the mounting flange and discharge end portion 73 with the filling tube extending therethrough is a wing assembly that includes wings Y and Z that may be a single unitary unit and integrally joined along top and bottom axial lines designated F, or may be two sections, front and rear, that each is a unitary section suitably joined to the other along the peripheral edge 32. The rear portion of the wing assembly 70 of each of the wings Y and Z respectively include rear top panels 74 and 75, rear bottom panels 77 and 78, and rear rounded side portions 76 and 79 joining the predominantly axially extending edges of the adjacent rear top and bottom panels on the respective transverse diametric opposite sides of the central axis to open toward the filling tube. The top panels 74 and 75 have arcuately curved top portions 74A and 75A respectively that in combination are arcuately curved to conform to the top portion 71A of the filling tube and transverse portions 74B and 75B respectively that are sloped transversely outwardly and downwardly from the arcuate portions to the top, predominantly axially extending edges of the rounded portions 76 and 79 respectively. Further, the bottom panels 77 and 78 respectively have arcuately curved bottom portions 77A and 78A which in combination are curved to conform to the bottom portion of the filling tube and transverse portions 77B and 78B that are sloped transversely outwardly and wpwardly from the arcuate bottom portions to the bottom axially extending edges of the rounded portions 76 and 79. The juncture of the predominately axially extending edges of the rounded edge portions 76 and 79 to the predominately axially edges of the top and bottom rear panels 75 and 78 respectively is indicated by dotted line L in FIG. 6.

The front section of the wing assembly 70 of each wing Y and Z includes front top panels 80 and 84, front bottom panel 81 and 85, and rounded side portions 83 and 87 joining the predominantly axially extending edges of the front top and bottom panels to open toward the filling tube on transverse opposite sides thereof. The front top and bottom panels have top arcuate portions 80A, 84A and 81A, 85A and transversely sloped portions 80A, 84A and 81A, 85A joined to the rounded side portions 83 and 87 such as described with reference to the rear panel portions. The front vertical edges of the rounded side portions 76 and 79 may be integrally formed with or otherwise suitably joined to the rear vertical edges of the rounded side portions 83 and 87 respectively.

The front peripheral edge 82 of the combination of the rear panels of the wings Y and Z are integrally formed with or suitably joined to the corresponding rear of the front panels. In a forward axial direction, the combination of the front top panels 80 and 84, the front bottom panels 81 and 85 and the front rounded side portions 83 and 87 gradually transition from a somewhat flat elliptical shape to a circular shape that conforms to the outer circumference of the filling tube similar to the wing assembly of the first embodiment. As viewed from the top, the rounded side portions 76 and 79 converge with the filling tube central axis at equal angles in a forward direction while the rounded side portions 83 and 87 likewise converged with the central axis but at a larger included angle than that of the convergence of the rounded side portions 76 and 79. The angles of convergence of the rounded side portions of the second embodiment advantageously are within the limits set forth relative to the first embodiment. Similarly, the rounded side portions of the second embodiment are likewise vertically centered with reference to the filling tube central axis and in transverse cross section are of progressively larger radii in a forward direction.

The angles of transverse divergence K of the portions 75B and 77B of the panels 74 and 77 from the axial rearwardmost, transverse edges 92 of the wing assembly in transverse planes progressively increases in an axial forward direction and thence along panels 80 and 81 at larger angles as do the arcuate dimensions of the panel arcuate portions 75A and 77B and the radii of curvature of rounded side portions of the Y to the front circular edge 93 of the wing assembly. The angles of transverse divergence and the arcuate portions of the panels of wing Z similarly increase and thus wings Y and Z are symmetrical.

Advantageously, the rear, transverse outer corner portions of the rear parts 88 and 89 of wings Y and Z may have cut-outs 88 and 89 of axial lengths that may be less than ten percent of the axial length of the wing assembly and of transverse dimension less than the radius of the filling tube.

As apparent from the description of the second embodiment, the angle of convergence of the wing assembly side rounded portions as viewed from the top, does not have to be of one angle throughout their axial length. The use of the second embodiment and the advantages thereof are similar to that set forth relative to the first embodiment.

With this invention, with a larger valve sleeve in a fully opened position, the transverse dimension of the wing assembly at its axial rear peripheral edge is increased while using a same diameter filling tube and the maximum vertical height of the wing assembly is not changed. Thus the angle of convergence of the wing assembly rounded side edges may be increased within limits, but if the angle becomes too large, it becomes undesirably difficult to position the bag on the spout. The range of diametric sizes of valve sleeves with which a given spout can be used is in part limited by the location of the bag filler machine mechanism for clamping the bag to the spout and the relative spacing of the valve sleeve interior and exterior outlets and the exterior outlet from the adjacent bag end wall. The axial length of the wing assembly and the angle of convergence of the wings as viewed from the top and the relative axial dimensions of the filling tube and the wing assembly, are in part dependent on the depth of the valve sleeve which in turn is in part dependent on the length and width dimensions of the bag top. Further, with a given wing assembly, the range of valve sleeve interior peripheral dimensions is limited by the extend the spout can be extended into the valve sleeve in sealing relationship and still be clamped to the spout by the filling machine clamp mechanism. In the event with a given diameter filling tube, the transverse dimension and angle of convergence of the wing rounded side portions becomes so great it becomes difficult to position the valve sleeve on the spout, then it becomes necessary to use a larger diameter filling tube.

Even though the invention has been described with reference to a valve sleeve, it is to be understood the spout may be likewise used in the event the valve is formed by the folding of the bag top infold and outfold flaps without the provision of a separate valve sleeve. Further, even though the invention has been described with reference to the filling tube extending through the wing assembly, it is to be understood the wings may be joined to the top and bottom portions of the filling tube without the wings extending completely around the filling tube. In such an event, it still is desirable the wing top and bottom panels be joined to the filling tube to extend, at least initially, generally tangential transversely away from the filling tube at their point of juncture.

What is claimed:

1. Valve bag spout apparatus extendable into a bag valve sleeve for filling a valve bag, comprising an axially elongated filling tube having a central axis of elongation, an outer peripheral surface, a top portion, a bottom portion, diametric opposite sides, a front end and a rear end., a front discharge end portion joined to the tube front end, a first wing joined to the filling tube to extend transversely outwardly of one side of the tube, and a second wing joined to filling tube to extend transversely outwardly of the other side of the filling tube, the wings converge toward the central axis in a forward direction and the maximum transverse dimension of the combination of the filling tube and wings being substantially greater than the maximum vertical dimension of one of the filling tube and the wings, the wings in plan view having transverse outer side portions that converge in a forward direction at substantially equal angles relative to the central axis and of maximum vertical dimensions substantial less than the vertical dimension of the filling tube.

2. The valve bag spout apparatus of claim 1 wherein the wings in combination comprise a wing assembly having a rear portion that in transverse cross section are generally of flattened elliptical shape and a front end portion that is substantially circular in transverse cross section.

3. The valve bag spout apparatus of claim 2 wherein the side portions are transversely and vertically centered relative to the central axis.

4. The valve bag spout apparatus of claim 1 wherein each wing side portion has a top and a bottom predominantly axially extending edge and each wing includes axially extending top and bottom panels, the top panel being joined to the adjacent side portion top edge to extend transversely and upwardly toward the filling tube and the bottom panel being joined to the adjacent side portion bottom edge to extend transversely and downwardly toward the filling tube.

5. The valve bag spout apparatus of claim 4 wherein the filling tube is of a substantially constant diameter throughout its axial length and a mounting flange is joined to the filling tube rearwardly of the wings.

6. The valve bag spout apparatus of claim 4 wherein the wings are symmetrical and oppositely disposed.

7. The valve bag spout apparatus of claim 4 wherein the filling tube in transverse cross section is circular, the top panels have arcuate portions joined to one another that are curved to conform to the filling tube top portion and the bottom panels have arcuate portions joined to one another and are curved to conform to the filling tube bottom portion.

8. The valve bag spout apparatus of claim 7 wherein the wings in combination comprise a wing assembly having a rear portion that in transverse cross section is generally of flattened elliptical shape and a front end portion that is generally circular in transverse cross section in surrounding abutting relationship to the filling tube axially adjacent to the discharge end portion.

9. The valve bag spout apparatus of claim 8 wherein the axial length of the wing assembly is substantially greater than the maximum transverse dimension of the wing assembly and the maximum transverse dimension of the wing assembly is at least one and half times the outer diameter of the tube and substantially greater than its maximum vertical dimension.

10. Valve bag spout apparatus extendable into a valve sleeve in the top of a valve bag of given width in a sleeve closed condition for filling the valve bag and the valve sleeve being of a given internal peripheral dimension, comprising an axially elongated filling tube having a central axis of elongation, an outer peripheral surface of a peripheral dimension that is substantially smaller than the sleeve internal peripheral dimension, a top portion, a bottom portion, diametric opposite first and second sides, a front end of a given vertical dimension, and a rear end, a front discharge end portion joined to the tube front end to extend generally axially forwardly of the tube and having an outer peripheral surface providing a smooth transition to the filling tube front end in an axial direction, and means joined to the filling tube to extend transversely outwardly of the filling tube to, one of alone and in combination with the filling tube, form a close fit with the sleeve internal surface, said means having a rear end portion of a transverse dimension substantially greater than the tube front end vertical dimension and a vertical dimension nearly the same as the tube front end vertical dimension and substantially smaller than the means rear end portion and a front end portion in transverse cross section being of substantially the same peripheral dimensions as that of the filling tube front end, and said means having transversely opposite side portions that converge in a forward direction from the means rear end portion.

11. The valve bag spout apparatus of claim 10 wherein said means comprises a first member joined to the filling tube to extend transversely outwardly from the first diametric side of the filling tube, and a second member joined to the filling tube to extend transversely outwardly from the second diametric opposite side of the filling tube, the first and second member each having one of the side portions and top and bottom rear surface portions that diverge from the respective side portions in a transverse direction toward the filling tube.

12. The valve bag spout apparatus of claim 11 wherein the member side portions have rear portions arcuately curved to open toward the adjacent filling tube side and the first and second members have transversely arcuately curved top and bottom portions that are curved about radii that are about one half of the outer diameter of the filling tube.

13. The valve bag spout apparatus of claim 12 wherein the member side portions in transverse planes are of the same vertical dimensions and transversely and vertically center relative to central axis.

14. The valve bag spout apparatus of claim 10 wherein said means comprises oppositely faced, substantially identical axially elongated first and second wings respectively extending transversely outwardly from the filling tube first and second sides, the maximum outer peripheral dimension of the combination of the wings and the filling tube being sufficient to form a close fit with the valve sleeve inner periphery in an open condition.

15. The valve bag spout apparatus of claim 14 wherein the wings have the means side portions, rear end portions that in transverse cross section are of generally flattened semi-elliptical shape and front end portions of generally semi-circular tubular shape, said filling tube front end being of a circular tubular shape of an outer diameter substantially smaller than the maximum transverse spacing of the wing side portions.

16. The valve bag spout apparatus of claim 15 wherein the wings each have top and bottom panels that have transversely arcuately curved portions forming a close fit with the filling tube top and bottom portions respectively and are of progressively arcuately curved dimensions in a forward direction and second top and bottom panel portions that transversely converge toward the filling tube and are joined to the arcuate portions.

17. The valve bag spout apparatus of claim 16 wherein the second panel portions in transverse planes perpendicular to the central axis are liner and are progressively smaller transverse dimensions in a forward direction.

18. The method of filling a valve bag that has a bag top with a valve sleeve having an exterior opening and an inlet opening that opens to the bag interior, and in an open condition, having a given interior peripheral dimension, the step of inserting a bag spout into the valve sleeve to initially open the valve sleeve to a generally circular shape and then progressive maintaining the height of the valve sleeve opening relatively constant while progressive further mechanically increasing the valve sleeve opening transversely on transverse diametric opposite sides of the valve tube before discharging product into the bag.

* * * * *